US006525627B2

(12) United States Patent
Nakada

(10) Patent No.: US 6,525,627 B2
(45) **Date of Patent: *Feb. 25, 2003**

(54) VARIABLE PHASE SHIFTER WITH REDUCED FREQUENCY-DEPARTMENT PHASE DEVIATIONS

(75) Inventor: Kuniyoshi Nakada, Tokyo (JP)

(73) Assignee: NEC Corporation, Tokyo (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/540,984

(22) Filed: Mar. 31, 2000

(65) Prior Publication Data

US 2002/0153967 A1 Oct. 24, 2002

(30) Foreign Application Priority Data

Apr. 2, 1999 (JP) ..... 11-096956

(51) Int. Cl.[7] ..... H01P 1/18
(52) U.S. Cl. ..... 333/161; 333/156
(58) Field of Search ..... 333/161, 156, 333/138, 236

(56) References Cited

U.S. PATENT DOCUMENTS 5,116,807 A * 5/1992 Romanofsky ..... 505/1

FOREIGN PATENT DOCUMENTS

| | | |
|---|---|---|
| JP | 57-67401 | 10/1955 |
| JP | 58-85349 | 6/1983 |
| JP | 63-123202 | 5/1988 |
| JP | 2-44403 | 3/1990 |
| JP | 5-63101 | 8/1993 |
| JP | 5-508060 | 11/1993 |

* cited by examiner

*Primary Examiner*—Robert Pascal
*Assistant Examiner*—Kimberly E Glenn
(74) *Attorney, Agent, or Firm*—Sughrue Mion, PLLC

(57) ABSTRACT

A variable phase circuit for microwave and millimeter wave applications includes a distributed-constant transmission line, a number of phase shifters respectively responsive to control signals for introducing a desired amount of phase shift to and removing the introduced phase shift from the transmission line. In order to compensate for the frequency-dependent phase deviation of each phase shifter, one or more loading stubs are selectively connected to or disconnected from the transmission line according to operation of the phase shifters.

18 Claims, 7 Drawing Sheets

VARIABLE PHASE SHIFTER WITH REDUCED FREQUENCY-DEPARTMENT PHASE DEVIATIONS

BACKGROUND OF THE INVENTION

1. Field of the Invention

The present invention relates to a variable phase shifter for use in the microwave and millimeter-wave regions. This invention is particularly useful for applications such as phased array antennas.

2. Description of the Related Art

In a phased array antenna, a variable phase shifter is used to introduce a fixed amount of phase shift to signals carried on a transmission line. Conventional phase shifters are of two types, i.e., a switched line type and a loaded line type. The switched line variable phase shifter comprises two line segments of different length selectively connected to the transmission line and the differential path length between them determines the amount of phase shift to be introduced. The transmission line is switched over from one line segment of the phase shifter to the other when a phase shift is introduced and switched back to the original line segment when the phase shift is removed. If the intended phase shift is 180 degrees, the differential path length is equal to the half wavelength of the center frequency of the signal on the transmission line. However, the phase shift value tends to deviate linearly from the intended value as the frequency of the signal deviates in either direction from the center (nominal) frequency. To maintain the phase deviation in a small range, it is necessary to control the frequency of the signal to within narrow limits.

The loaded line phase shifter comprises a pair of spaced-apart main stubs extending from the transmission line and a pair of extension stubs selectively coupled to the main stubs. The phase shifter of this type also suffers from the frequency-dependent phase deviation. Specifically, the characteristic of the loaded line type has a minimum phase deviation at the center frequency. If the circuit layout is optimized, there exist a nonlinear negative phase deviation from the intended value that increases as the frequency decreases in a direction away from the center frequency and a nonlinear positive phase deviation from the intended value that increases as the frequency increases in a direction away from the center frequency. If the circuits are laid down perfectly, the negative and positive phase variations follow a curve that is symmetrical with respect to the nominal frequency. However, due to inherent imperfections, the characteristic curve loses the symmetricity and the phase shift value deviates from the intended value with frequency deviation of the signal from the nominal value, in a manner similar to the switched line phase shifter.

SUMMARY OF THE INVENTION

It is therefore an object of the present invention to provide a variable phase circuit in which the frequency-dependent phase deviation is compensated.

According to a broader aspect, the present invention provides a variable phase circuit comprising a transmission line, a phase shifter for introducing a phase shift to and removing the phase shift from the transmission line, an open-ended loading stub, and a switch for connecting the open-ended loading stub to and disconnecting the loading stub from the transmission line according to operation of the phase shifter.

The open-ended loading stub has the effect of cancelling phase deviation of the signal as its frequency deviates from nominal (center) frequency.

According to a second aspect of the present invention, there is provided a variable phase circuit comprising a transmission line, a plurality of phase shifters respectively responsive to control signals for introducing one of a plurality of different phase shifts to and removing the introduced phase shift from the transmission line, a plurality of loading stubs, and a plurality of switches for selectively connecting the loading stubs to and disconnecting the loading stubs from the transmission line in accordance with operation of the phase shifters.

BRIEF DESCRIPTION OF THE DRAWINGS

The present invention will be described in further detail with reference to the accompanying drawings, in which.

DETAILED DESCRIPTION

Figure 1:
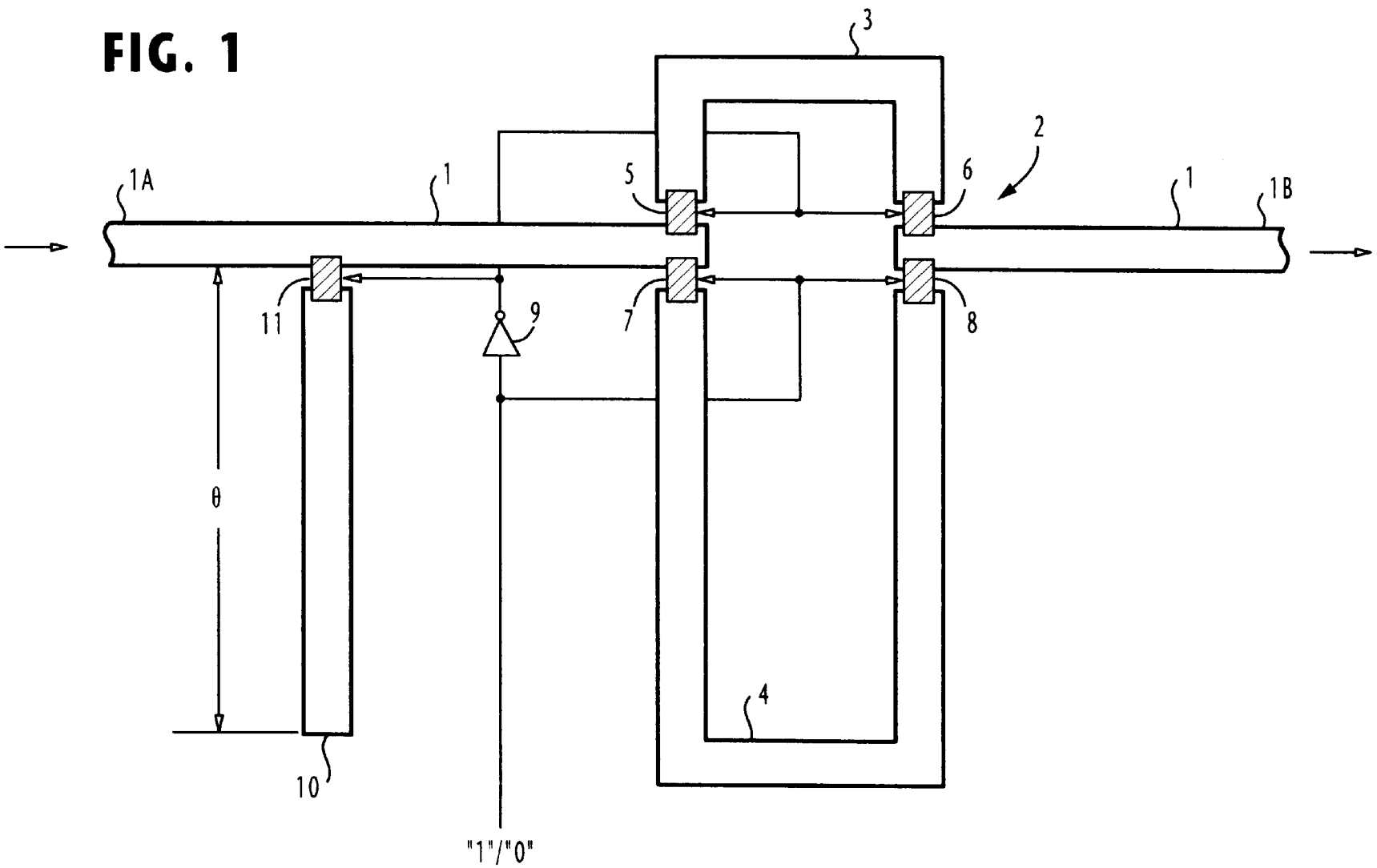
FIG. 1 is a diagram of an improved variable phase circuit of the present invention using a switched line phase shifter.

The variable phase circuit of the present invention can be implemented with a phase shifter of either of two configurations, i.e., the differential path length type or the differential loading type. FIG. 1 shows the basic principle of the inventive variable phase circuit implemented with a switched line phase shifter.

In FIG. 1, the switched line phase shifter, as indicated by numeral 2, is connected in a distributed constant circuit, or transmission line 1, which may be formed by a microstrip line on a microwave integrated circuit. Over the transmission line 1, a high-frequency signal propagates in a direction from an input end 1A to an output end 1B.

Switched line phase shifter 2 comprises a line segment 3 of shorter length and a line segment 4 of longer length. In the case of a 180-degree phase shift, for example, the difference in length between the line segments 3 and 4 equals the half wavelength (i.e., $0.5\lambda$) of the propagating signal when the signal components are concentrated at the center frequency. To the input and output sections of transmission line 1, the opposite ends of line segment 3 are respectively connected by a pair of switches 5 and 6 and the opposite ends of line segment 4 are respectively connected by a pair of switches 7 and 8.

If the intended phase shift is 90 degrees, the line segments of a 90-degree switched line phase shifter are chosen so that their differential path length corresponds to the quarter wavelength of the signal, which is half the differential path length of the 180-degree switched line phase shifter.

Switches 5, 6, 7 and 8 are provided for selectively connecting the two line segments. In response to a binary signal "1" from an external control circuit, not shown, switches 5 and 6 are simultaneously operated to connect the line segment 3 to the transmission line 1 and switches 7 and 8 are simultaneously released, so that the signal on the transmission line 1 exclusively passes through the line segment 3. In response to a binary signal "0", the switches 5 and 6 are simultaneously released and switches 7 and 8 are simultaneously operated, so that the signal on the transmission line 1 is switched over from the line segment 3 to the line segment 4 and exclusively passes through the longer line segment 4.

Such alternate switching operation may be achieved by supplying individual binary signals from the control circuit or inverting a binary signal from the control signal with an inverter 9, as illustrated.

In order to compensate for the frequency-dependent phase deviation of phase shifter 2, the present invention provides an open-ended loading line segment, or loading stub 10. Loading stub 10 is connected to the transmission line 1 through a switch 11 in response to the output of inverter 9 when the shorter line segment 3 is connected to the transmission line by the switches 5 and 6.

The reactance X of open-ended loading stub 10 is given as follows:

$$X=-Z_s\cdot\cot(2\pi\theta/\lambda)$$

where, $Z_s$ and $\theta$ are the characteristic impedance of the loading stub 10 and its electrical length, respectively, and $\lambda$ is the wavelength of the signal on the transmission line 1.

Figure 2:
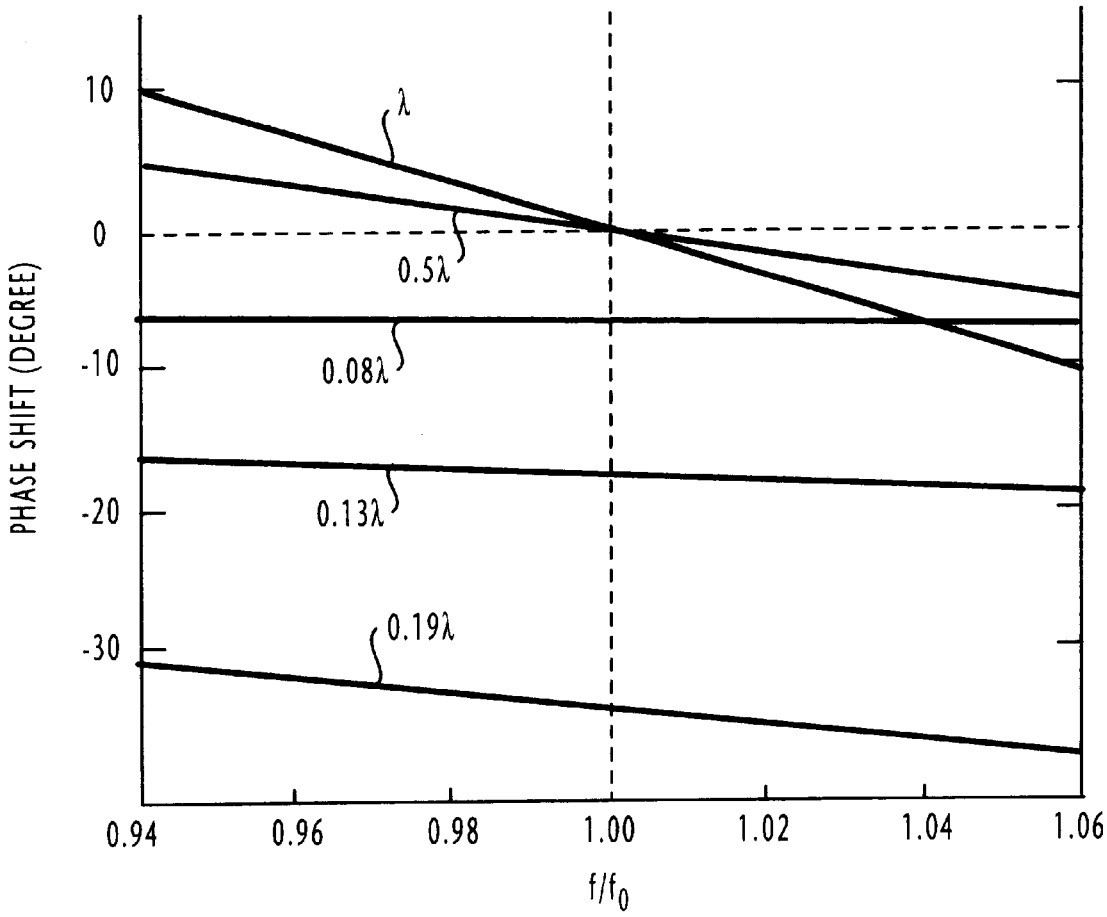
FIG. 2 is a graphic representation of phase deviation characteristics of open-ended loading stubs of different lengths.

FIG. 2 shows results of computer simulation in which loading stubs of various electrical lengths are tested by connecting each to the transmission line 1 (with the variable phase shifter 2 being disconnected) and phase variations of signals on the transmission line as a function of different frequencies are measured and plotted against the ratio of the varying frequency (f) of the signals to their center frequency $f_0$. It is seen from FIG. 2 that the phase deviation of loading stubs of lengths $\lambda$ and $0.5\lambda$ are inversely variable with the frequency ratio $f/f_0$ and their characteristics vary symmetrically with respect to a zero degree phase shift.

Since the frequency-dependent phase variation of loading stubs 10 of different lengths decreases as frequency increases, it is found that their characteristics are opposite to that of the switched line phase shifter 2 itself. This is particularly clear when the length of loading stub 10 is $\lambda$ or $0.5\lambda$. Therefore, the loading stubs of these lengths can be advantageously used in combination with the switched line phase shifter 2 as a means for compensating for its undesired frequency-dependent phase deviation.

Since the results obtained from the loading stubs of lengths $0.08\lambda$, $0.13\lambda$ and $0.19\lambda$ show that their phase variations significantly deviate from the zero degree point, the connection of such loading stubs would produce an impedance matching problem. A separate impedance matching circuit would therefore be necessary to solve this problem. In some applications where strict phase deviation compensation is not required, the use of such impedance matching circuit would be justified to use loading stubs of lengths other than $\lambda$ and $0.5\lambda$. These loading stubs can also be used if the design of the phase shifter 2 has taken account of such phase deviations from the zero-degree point.

Accordingly, by choosing the loading stub length $\theta$ as an integral multiple of $0.5\lambda$, the phase of the signal is always at zero degree at center frequency $f_0$ and there is no need to take account of such impedance matching or design consideration.

Figure 3:
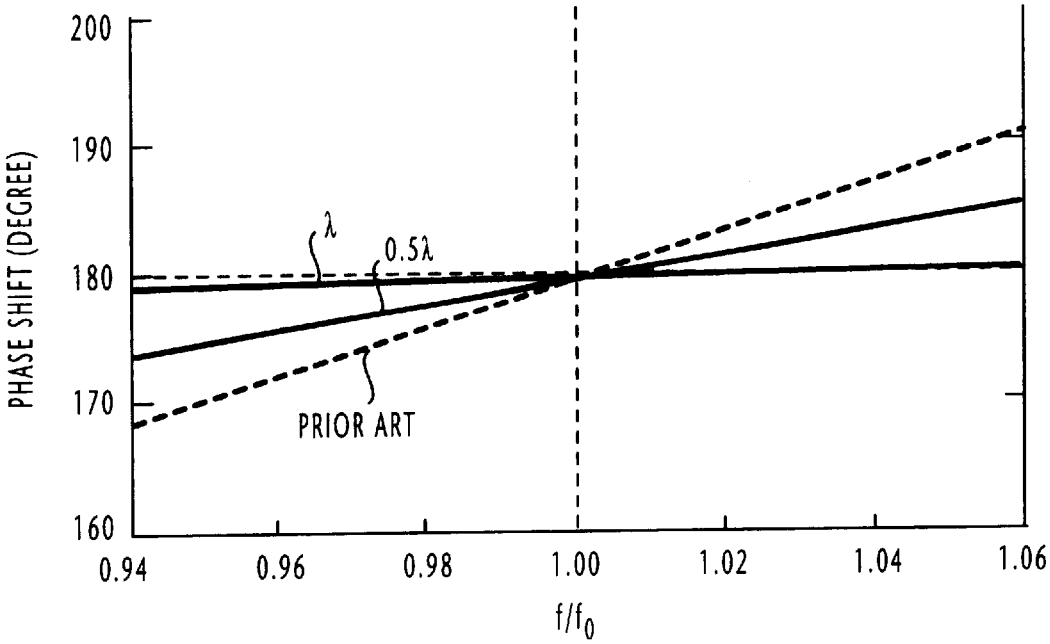
FIG. 3 is a graphic representation of phase deviation characteristics of improved variable phase circuits of the present invention by using a 180-degree switched line phase shifter in comparison with a prior art 180-degree switched line phase shifter.

FIG. 3 shows results of computer simulation in which loading stubs 10 of lengths $\lambda$ and $0.5\lambda$ are used in combination with a 180-degree switched line phase shifter 2. Phase variations of signals on the transmission line 1 are measured as a function of frequency ratio $f/f_0$ and plotted in the same manner as described above. It is seen in FIG. 3 that when a loading stub 10 of length $\lambda$ is used, its negative frequency-dependent phase deviation characteristic substantially cancels the positive frequency-dependent phase deviation characteristic of the switched line phase shifter 2 itself, thus allowing a wideband signal to be precisely phase-shifted by a predetermined amount. Note that with a loading stub length $0{,}5\lambda$ the overall characteristic of the variable phase shift favorably compares with that of the prior art switched line phase shifter (i.e., with no loading stub) as indicated by a dotted line in FIG. 3. With the loading stub lengths $\lambda$ and $0.5\lambda$, there is no additional phase shift at the zero degree point since the transmission line 1 and the loading stub 10 are matched in impedance.

Figure 4:
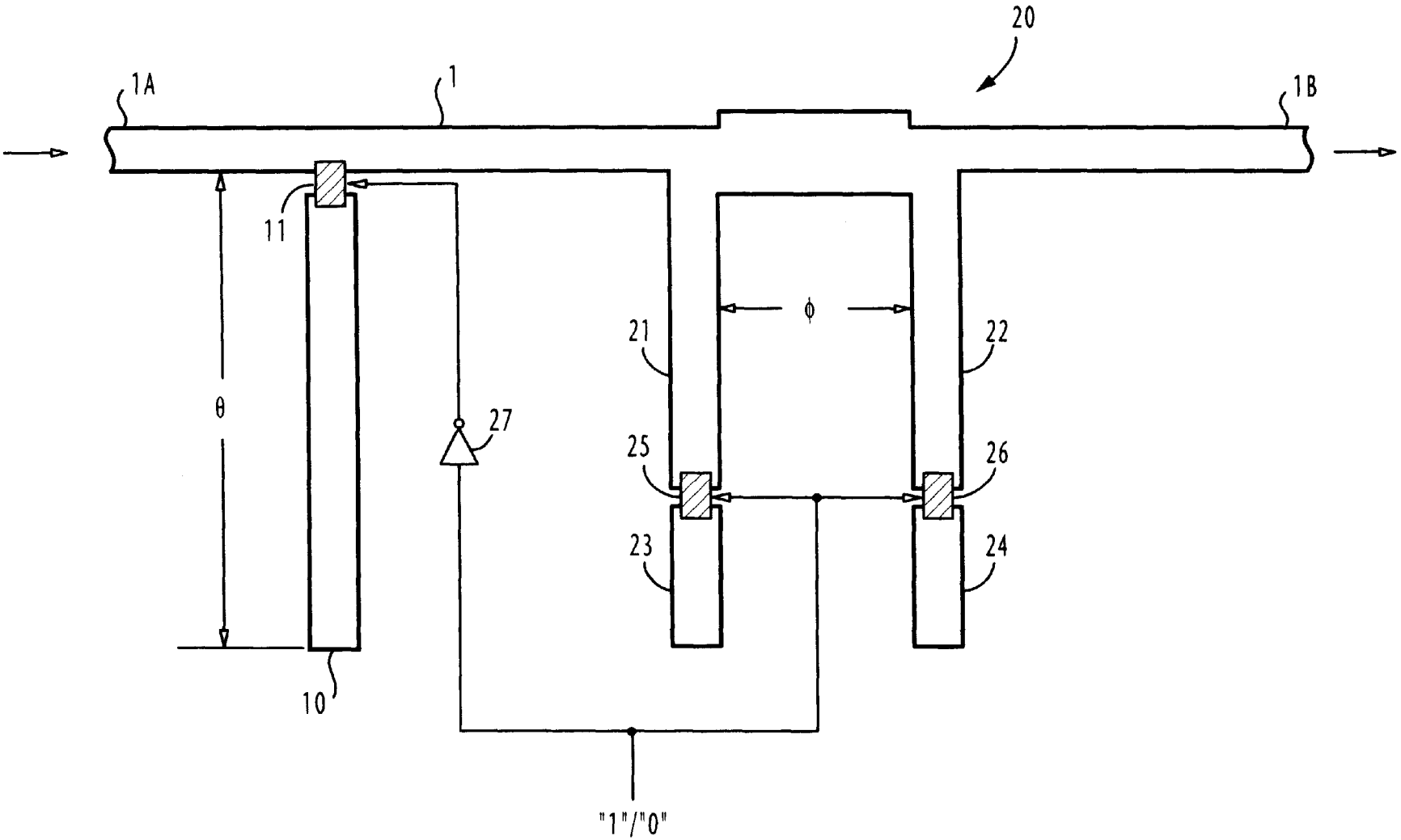
FIG. 4 is a diagram of an improved variable phase circuit of the present invention using a loaded line phase shifter.

FIG. 4 shows another embodiment of the present invention in which the switched line phase shifter 2 of FIG. 2 is replaced with a loaded line phase shifter 20. This loaded line phase shifter comprises a pair of main stubs 21 and 22 extending from the transmission line 1. These main stubs are mutually spaced apart a distance $\Phi$ which may be equal to the quarter wavelength ($\lambda/4$) of the signal at the center frequency $f_0$. Main stubs 21 and 22 are connected to extension stubs 23 and 24 by switches 25 and 26, respectively. Switches 25 and 26 are simultaneously operated in response to a binary signal "1" from the control circuit to establish connections between the main stubs 21, 22 to the extension stubs 23, 24.

Loaded line phase shifter 20 has a nonlinear frequency-dependent phase deviation characteristic and this characteristic further deviates from the center frequency of the signal and loses symmetrical characteristic. Depending upon which side of the center frequency such phase deviation characteristic further deviates, the switch 11 of the loading stub 10 is operated. If the further deviation is on the higher side of the center frequency, the control signal is supplied via an inverter 27 to the switch 11 so that it connects the open-ended loading stub 10 to the transmission line 1 when the extension stubs 23 and 24 are disconnected from the main stubs 21, 22. If the further deviation is on the lower side of the center frequency, the switch 11 is operated so that the loading stub 10 is disconnected to the transmission line when the extension stubs 23, 24 are connected to the main stubs 21, 22.

Figure 5:
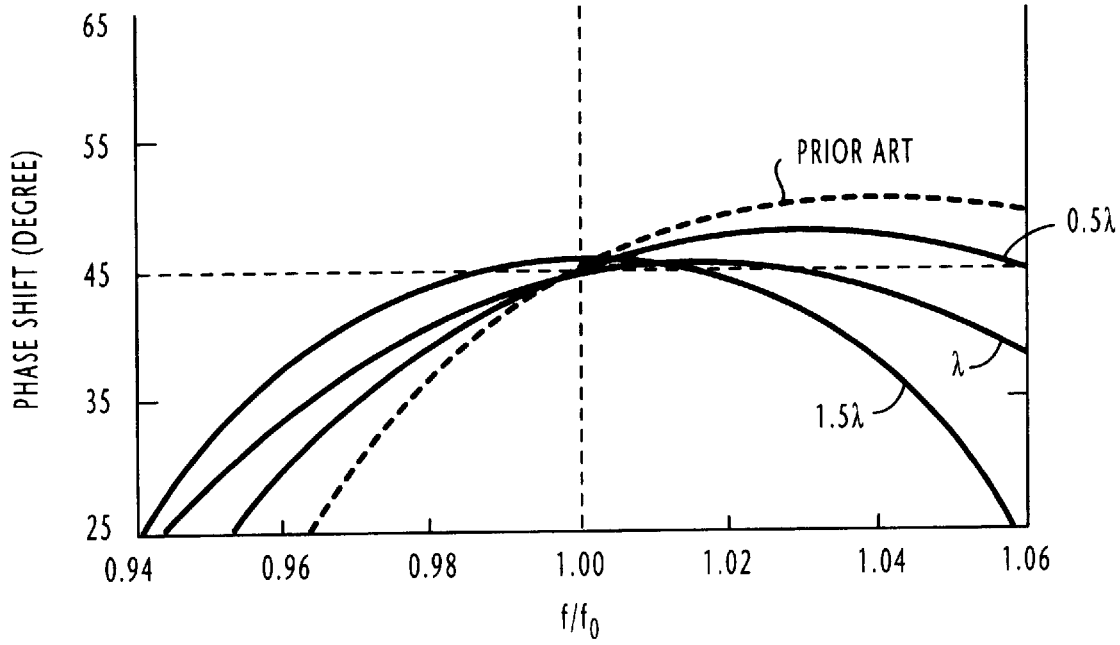
FIG. 5 is a graphic representation of phase deviation characteristics of variable phase circuits of the present invention by using a 45-degree loaded line phase shifter in comparison with a prior art 45-degree loaded line phase shifter.

FIG. 5 shows results of experiments in which loading stubs 10 of lengths $1.5\lambda$, $\lambda$ and $0.5\lambda$ are used in combination with a 45-degree loaded line phase shifter 20. Phase variations of signals on the transmission line 1 are measured as a function of different frequencies and plotted in the same manner as described above. It is seen that when a loading stub 10 of length $1.5\lambda$ is used, the overall phase deviation becomes symmetrical with respect to the nominal frequency $f_0$. Note that with stub lengths $\lambda$ and $0{,}5\lambda$ the overall characteristics favorably compare with that of the prior art phase shifter (i.e., with no loading stub) as indicated by a dotted line in FIG. 5.

Experiments show that the differential path length type phase shifter 2, FIG. 1, is suitable for implementing a large value of phase shift, while the differential loading phase shifter 20, FIG. 4, is suitable for implementing a small value of phase shift.

Therefore, it is preferable that the phase shifter 2 is used for implementing 180- and 90-degree phase shifts by use of loading stubs 10 of lengths λ and 0.5λ, respectively, while the phase shifter 20 is used for implementing a 45-degree phase shift by using a loading stub 10 of length 1.5λ.

Figure 6:
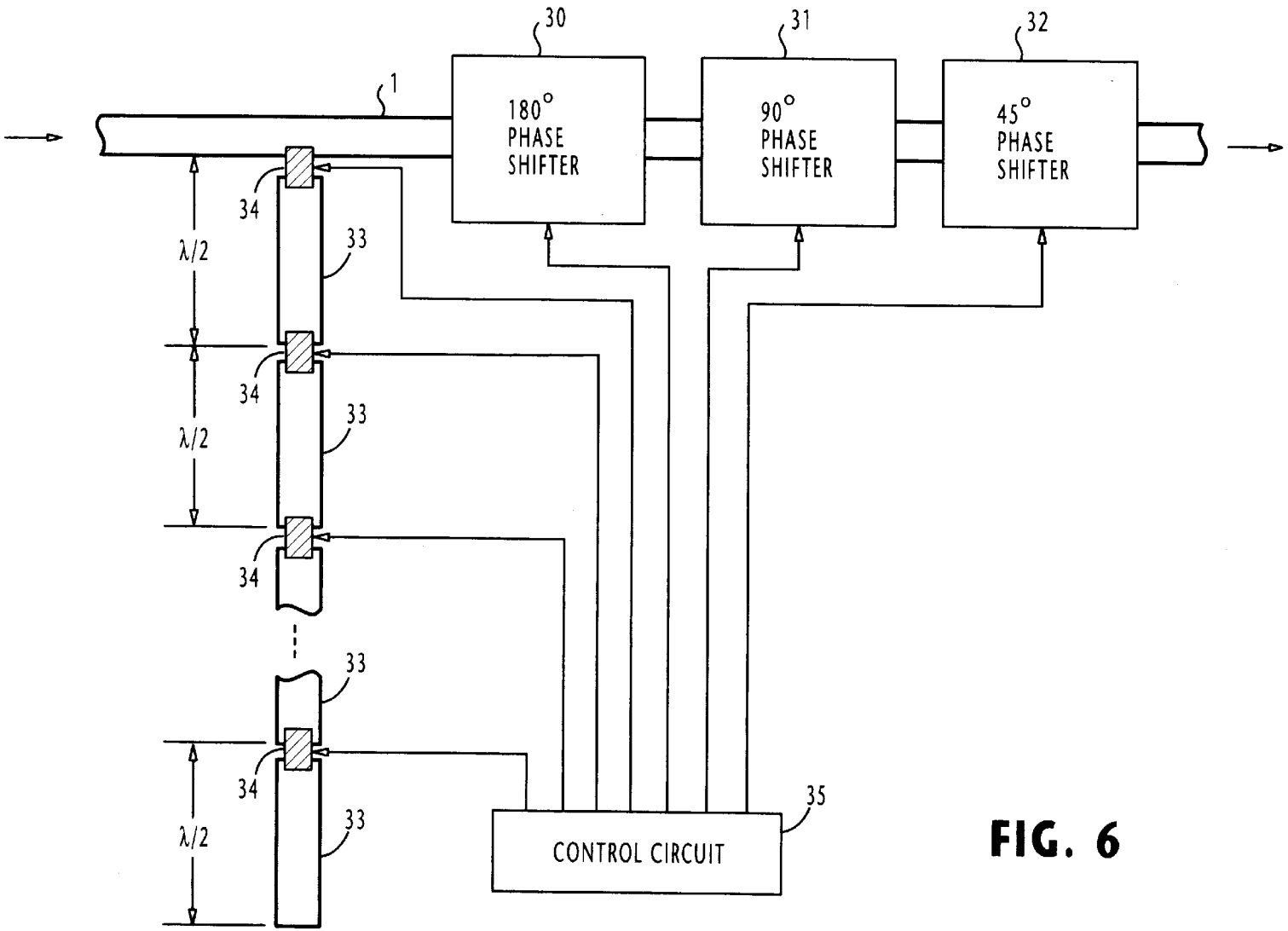
FIG. 6 is a diagram of a variable phase circuit according to a preferred embodiment of the present invention.

FIG. 6 is a block diagram of a 3-bit variable phase shifter according to a preferred embodiment of the present invention. This 3-bit variable phase shifter is comprised of a 180-degree phase shifter 30, a 90-degree phase shifter 31 and a 45-degree phase shifter 32, all of which are connected in series in the transmission line 1.

An open-ended loading stub of variable length is formed by a series of loading stubs 33 of length 0.5λ, all of which are selectively connected by switches 34 to the transmission line 1. Phase shifters 30, 31 and 32 are controlled by respective bits of a 3-bit code from a control circuit 35 so that these phase shifters are connected in a desired combination to the. transmission line.

Figure 7:
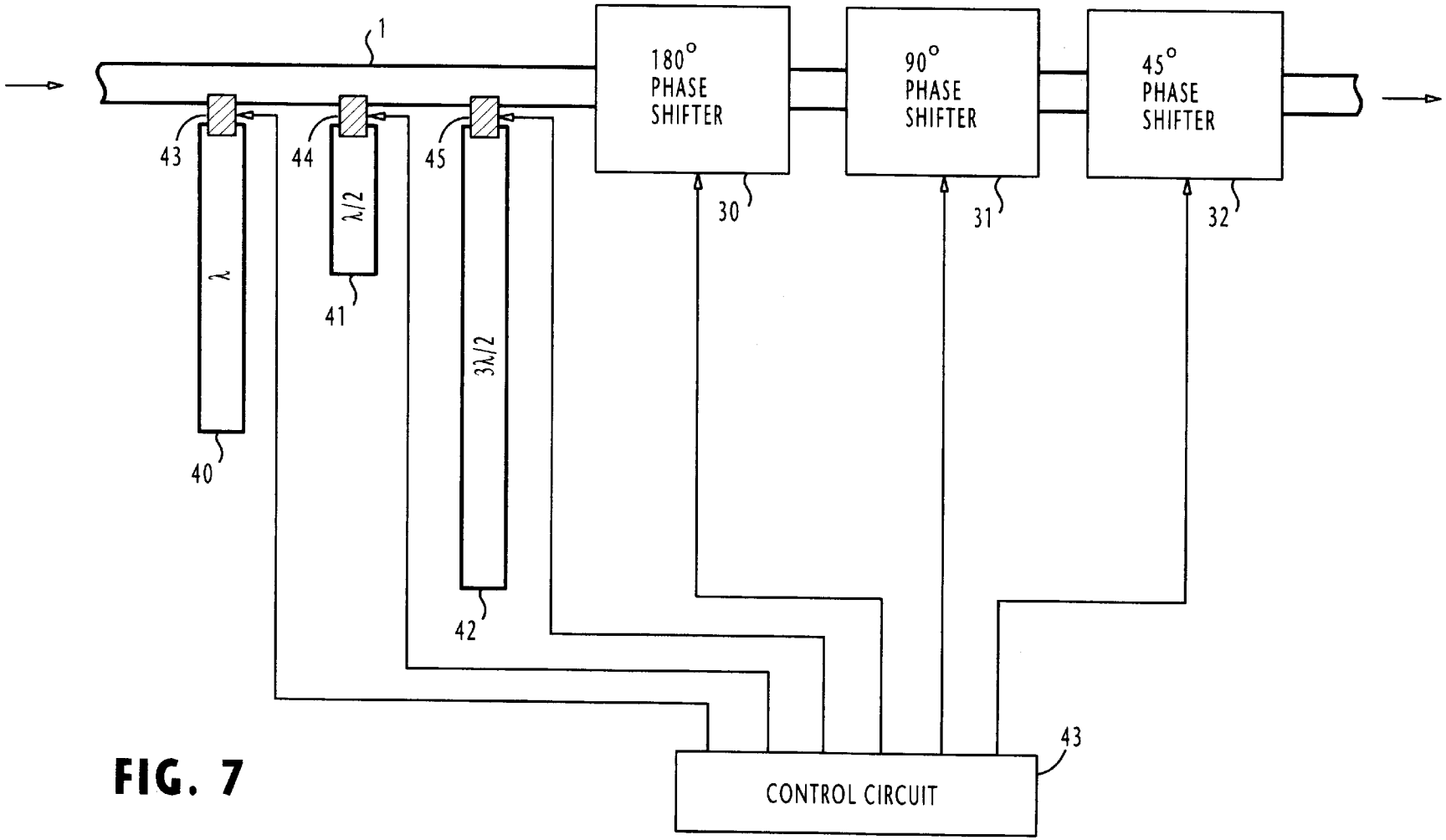
FIGS. 7 and 8 are diagrams of the variable phase circuit of alternative embodiments of the present invention.

Alternatively, open-ended loading stubs 40, 41 and 42 of different length may be coupled respectively by switches 43, 44 and 45 to the transmission line, as shown in FIG. 7, under control of a control circuit 43. The loading stubs 40, 41 and 42 have lengths λ, 0.5λ and 1.5λ, respectively.

Figure 8:
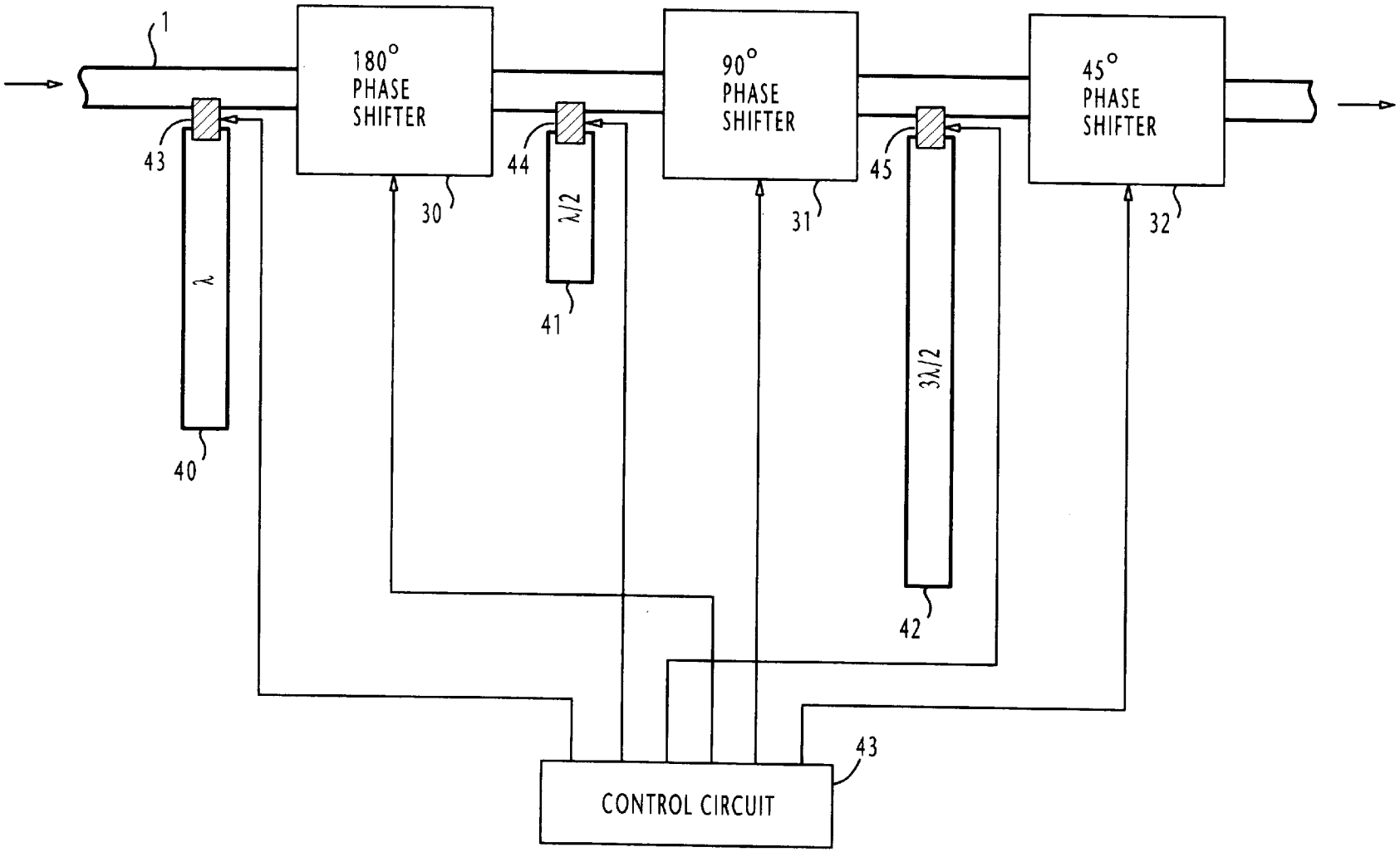

To achieve space saving and utilization, the embodiment of FIG. 7 may be modified as shown in FIG. 8, in which the open-ended loading stubs 40, 41 and 42 are located respectively adjacent the phase shifters 30, 31 and 32 so that spaces which would otherwise be left unused for other purposes may be utilized.

What is claimed is:

1. A variable phase circuit comprising:

a transmission line;

a phase shifter for introducing a phase shift to and removing the phase shift from said transmission line, the phase shifter being coupled to the transmission line;

an open-ended loading stub; and a switch for connecting the open-ended loading stub to and disconnecting the loading stub from said transmission line according to operation of said phase shifter.

2. A variable phase circuit as claimed in claim 1, wherein said open-ended loading stub has a length substantially equal to an integral multiple of a half wavelength of a signal propagating on said transmission line.

3. A variable phase circuit as claimed in claim 2, wherein said phase shifter comprises first and second line segments of different lengths and means for selectively interposing one of said first and second line segments in said transmission line.

4. A variable phase circuit as claimed in claim 3, wherein said switch is responsive to a control signal for connecting said loading stub to said transmission line when a shorter one of said first and second line segments is interposed in said transmission line.

5. A variable phase circuit as claimed in claim 3, wherein said phase shift is 180 degrees, and wherein said open-ended loading stub has a length substantially equal to a wavelength of said signal.

6. A variable phase circuit as claimed in claim 3, wherein said phase shift is 90 degrees, and wherein said open-ended loading stub has a length substantially equal to the half wavelength of said signal.

7. A variable phase circuit as claimed in claim 2, wherein said phase shifter comprises a first pair of mutually spaced-apart main stubs extending from said transmission line and a second pair of spaced apart extension stubs, and a pair of switches for connecting the extension stubs to and disconnecting the extension stubs from said main stubs.

8. A variable phase circuit as claimed in claim 7, wherein said switch is responsive to a control signal for connecting said loading stub to said transmission line when said extension stubs are not connected to said main stubs or disconnecting said loading stub from said transmission line when said extension stubs are connected to said main stubs, depending on phase deviation characteristic of the phase shifter.

9. A variable phase circuit as claimed in claim 3, wherein said means for selectively interposing comprise:

a first pair of switches that connect said first line segment to said transmission line; and a second pair of switches that said second line segment to said transmission line; and an inverting circuit connected to said first and second pair of switches.

10. A variable phase circuit as claimed in claim 8, wherein said first pair of main stubs are spaced apart by a length substantially equal to the quarter wavelength of said signal.

11. A variable phase circuit comprising:

a transmission line;

a plurality of phase shifters respectively responsive to control signals for introducing one of a plurality of different phase shifts to and removing the introduced phase shift from said transmission line;

a plurality of loading stubs; and a plurality of switches for selectively connecting said loading stubs to and disconnecting the loading stubs from said transmission line according to operation of said variable phase shifters.

12. A variable phase circuit as claimed in claim 11, wherein each of said loading stubs has a length substantially equal to a half wavelength of a signal propagating on said transmission line, and wherein said switches are arranged to selectively connect said loading stubs in series to said transmission line.

13. A variable phase circuit as claimed in claim 11, wherein each of said loading stubs has a different length substantially equal to an integral multiple of a half wavelength of a signal propagating on said transmission line, and wherein said switches are arranged to selectively connect said loading stubs to said transmission line.

14. A variable phase circuit as claimed in claim 13, wherein said plurality of loading stubs are respectively located adjacent said plurality of phase shifters.

15. A variable phase circuit as claimed in claim 11, wherein one of said phase shifters comprises first and second line segments of different lengths and means for selectively interposing one of said first and second line segments in said transmission line.

16. A variable phase circuit as claimed in claim 15, wherein said plurality of switches are responsive to control signals for connecting at least one of said plurality of loading stubs to said transmission line when a shorter one of said first and second line segments is interposed in said transmission line.

17. A variable phase circuit as claimed in claim 11, wherein one of said phase shifters comprises a first pair of mutually spaced-apart main stubs extending from said transmission line and a second pair of spaced apart extension stubs, and a pair of switches for connecting the extension stubs to and disconnecting the extension stubs from said main stubs.

18. A variable phase circuit as claimed in claim 15, wherein said means for selectively interposing comprise:

a first pair of switches that connect said first line segment to said transmission line; and a second pair of switches that connect said second line segment to said transmission line; and an inverting circuit connected to said first and second pair of switches.

* * * * *